US005649839A

United States Patent [19]

Yu

[11] Patent Number: 5,649,839

[45] Date of Patent: Jul. 22, 1997

[54] POWER CENTER

[76] Inventor: Jeff Yu, 2491 Ramke Pl., Santa Clara, Calif. 95050

[21] Appl. No.: 513,615

[22] Filed: Aug. 10, 1995

[51] Int. Cl.[6] ..... H01R 33/90

[52] U.S. Cl. ..... 439/650; 200/51 R; D13/142

[58] Field of Search ..... 439/650–654, 439/501, 535; 307/40, 41, 112; 361/114, 166, 625, 643; 200/51 R; D13/142

[56] References Cited

U.S. PATENT DOCUMENTS

| | | | |
|---|---|---|---|
| D. 288,920 | 3/1987 | Oesterheld et al. | D13/142 |
| D. 340,699 | 10/1993 | Chen | D13/142 |
| D. 354,737 | 1/1995 | Fladung | D13/142 |
| 4,867,701 | 9/1989 | Wiand | 439/501 |
| 4,930,047 | 5/1990 | Peterson | 200/51 R |
| 4,993,970 | 2/1991 | Littrell | 439/535 |
| 5,071,367 | 12/1991 | Luu | 439/501 |
| 5,109,316 | 4/1992 | Murphy | 439/535 |
| 5,232,381 | 8/1993 | Yu | 439/652 |
| 5,424,903 | 6/1995 | Schreiber | 307/40 |
| 5,457,600 | 10/1995 | Campbell et al. | 439/501 |

*Primary Examiner*—Neil Abrams
*Assistant Examiner*—Brian J. Biggi
*Attorney, Agent, or Firm*—Richard Liu

[57] ABSTRACT

A power center for using ON-OFF switches to control power availability for individual receptacle outlets is disclosed. The molded-in receptacle apertures and podded contact strips provide significant space, cost and efficiency improvements over existing power centers which use stand-alone, off-the shelve receptacle parts.

2 Claims, 2 Drawing Sheets

POWER CENTER

TECHNICAL FIELD

The invention relates to electrical power source enclosures and, more particularly, to power centers disposed on or near work surfaces for user convenience.

BACKGROUND ART

Electrical receptacles have long been used for supplying power to various types of devices, such as refrigerators, fans, electric typewriter, and the like. One problem common to relatively all types of residential, commercial and industrial environments utilizing electrical power outlet receptacles is the positioning of the same in a manner so as to facilitate both convenience and cost efficiency. More recently, this problem has been exacerbated by the proliferation of additional devices for computing and communications, such as complex telephone stations, computers, video displays, and numerous stand alone computer peripherals such as hard disk drives, tape drives, modems, printers, multimedia kits and the like. As many more of these computer-controlled peripheral devices are made available to the consumer market, electrical power distribution and its related issues are fast becoming problems requiring satisfactory solutions.

Some devices of a computer system are capable of being fed electrical power by other devices whereby potentially saving the usage of a few wall/extension cord receptacles. But most of the stand alone computer-controlled devices require separate lines connected to the wall receptacles and/or extension cord receptacles for electrical power. As the number of devices increases, electrical cabling behind a computer system become very messy to the eyes and very inconvenient to the users if any changes in configuration are to be made to the computer system.

Furthermore, typical multiple-receptacle extension cords on the floor or otherwise mounted onto furniture assemblies can not regulate the flow of electrical power on a receptacle-by-receptacle basis. Some cords available today do have ON-OFF switches controlling the flow of electrical power from the wall outlets to all of the receptacles but even so, none provides an ON-OFF switch for each receptacle. Being able to control individual receptacles is a desirable feature because in many occasions, portions of a computer system need not to be ON for user operations and having those portions OFF provide significant savings in the long run. There are modular power centers having multiple receptacles in the market today catering to computer systems whereby an ON-OFF switch is provided for each associated receptacle. But the existing power centers can not provide the maximum number of receptacles because of the waste of precious wall space due to the use of the off-the-shelve receptacle components.

Therefore, it is desirable to have a power center for a computer system providing as many electrical receptacles as possible for the computer system in the smallest amount of wall space possible.

SUMMARY OF THE INVENTION

A power center according to the invention overcomes these and other limitations by providing a modular housing suitably constructed for disposition either underneath other computer device housings on a work surface or in-between computer device housings, the power center having a power center cord and plug for connection to a wall receptacle and the power center further having a plurality of ON-OFF switches on the front side of the power center housing and each ON-OFF switch being electrically connected to the power center cord and plug and to an electrical receptacle of a plurality of receptacles which faces the backside of the power center. Relative to the plurality of receptacles on the housing, prong-receiving apertures of each receptacle are integrally formed on the backside of power center housing and three pods integral to and inside of the power center housing each having a lengthwise groove aligned suitably for receiving plug prongs of computer devices extending through the apertures.

Two of the pods each encases an electrically conductive contact strip and each strip being aligned with one aperture of each of the plurality of receptacles. The remaining pod encases a plurality of electrically conductive contact strips, each strip being aligned with one receptacle of the power center and the strip being electrically isolated from the other strips.

A flexible electrical conductor means electrically connects electrically conductive strips to the ON-OFF switches in a manner so that when a switch is ON, a device plug plugged into its associated receptacle would be suitably connected for drawing electrical power from the wall outlet via the power center plug and the ON-OFF switch; and when a switch is OFF, a device plug plugged into the associated receptacle would not be able to draw any electrical power from the wall outlet.

Additional features and advantages of the invention will become apparent to those skilled in the art upon consideration of the following detailed description of a preferred embodiment exemplifying the best mode of carrying out the invention as presently perceived. The detailed description particularly refers to the accompanying figures.

DETAILED DESCRIPTION

Reference will now be made in detail to a preferred embodiment of the invention, views of which are illustrated in the accompanying drawings. While the invention will be described in conjunction with the preferred embodiment, it will be understood that they are not intended to limit the invention to this embodiment. On the contrary, the invention is intended to cover alternatives, modifications, and equivalents, which may be included within the spirit and scope of the invention as defined by the appended claims.

A power center is preferred to be generally rectangular in shape and thin in the height dimension. Such a configuration would "blend" into the computer system well without taking up extra space in that it could be placed on top of a desk surface whereon another device such as a video display monitor or a printer sits or be placed between two devices such as a video display monitor and a processing unit. The shape of the power center can vary depending upon user tastes; however, the front side and the back side of the power center should be of sufficient length in order to accommodate a plurality of ON-OFF switches and a plurality of corresponding receptacles, respectively.

Figure 1:
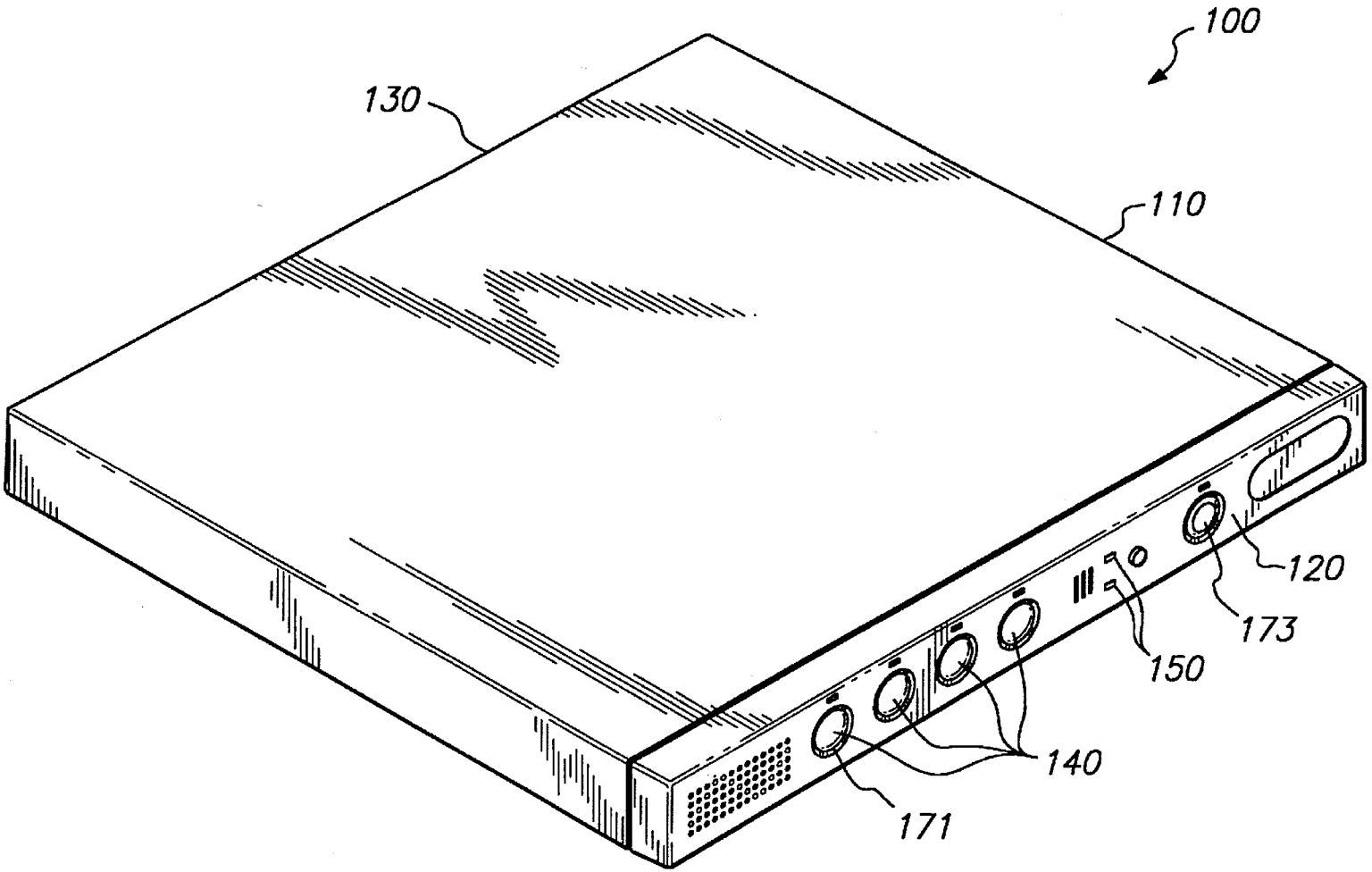
FIG. 1 is a front perspective view of a power center in accordance with the present invention.
Figure 2:
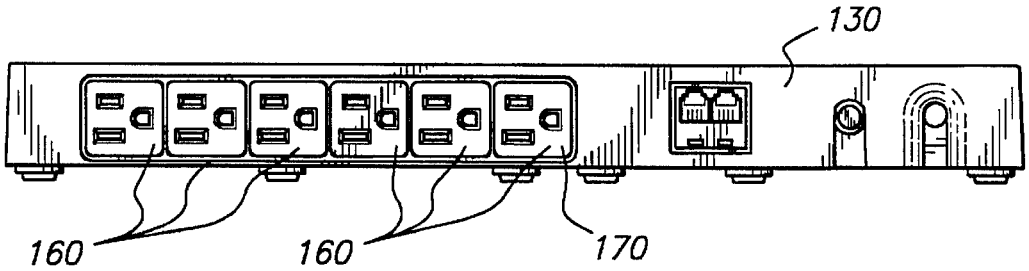
FIG. 2 is a rear elevational view of the power center of FIG. 1.

Now referring to FIGS. 1 and 2, a power center 100 for a computer system in accordance with the present invention is illustrated. A generally rectangular housing 110 for the power center 100 is disclosed in FIGS. 1 and 2. The housing 110 has a front side 120 and a back side 130. On the front side 120, a plurality of ON-OFF switches 140 and indicator lights 150 face a user; and a number of receptacles 160 are disposed on the back side 130 of the power center 100.

The plurality of receptacles 160 is disposed on a portion of the back side 130 of the power center 100. A typical receptacle has three apertures for receiving a 3-pronged plug of a computer device. The three prongs of the computer device plug are correspondingly and electrically coupled to the "hot", "neutral" and "ground" prongs of a power center plug which in turn is connected to a wall receptacle (not shown) for receiving electrical power. For each receptacle 170 on the back side 130 of the power center 100, there is an associated ON-OFF switch 171 located on the front side 120 of the power center 100. Electrical power will pass through the power center 100 from the wall outlet to a computer device when the ON-OFF switch 171 associated with the receptacle 170 into which the device is connected is ON. On the other hand, no power will be available for the device for use if that ON-OFF switch 171 is OFF.

Numerous types of ON-OFF switches exist in the market today, such switches include light-indicator switches, push-button switches, membrane switches and the like. In addition to the ON-OFF switches 140 on the power center 100 which have corresponding receptacles 160, another aspect of the present invention includes a special ON-OFF switch for the power center 100 is the master switch 173 where electrical power will not be available to plugged-in computer devices for distribution from the power center when it is switched OFF. In other words, in order for any power to be distributed to computer devices from the power center, the master switch 173 is typically serially connected with other ON-OFF switches and therefore must be switched ON. The master switch 173 itself may also directly control at least one receptacle. An application of this is to connect a computer processing unit to this directly controlled receptacle so that once the master swich is turned ON, the processing unit will always be selected to be ON along with other peripheral devices selected by other individual ON-Off switches. Also, albeit the one receptacle-to-one ON-OFF switch relationship, the number in the plurality of receptacles 160 may be more than the number of the ON-OFF switches 140 because some receptacles may bypass any ON-OFF switch and be ON as long as the power center plug is connected to the common power source. One reason is for the use of fax/modem which requires a constant power supply.

The apertures through which a computer device plug extends are integrally formed with the back side 130 of the power center 100. Various materials include metals and plastics may be suitable for the power center housing 110, but preferably, plastic materials should be used for their moldability. The molded-in feature of the receptacle apertures reduces the back side wall space required for aligning a series of receptacles generally next to each other because these integrated apertures do not require space clearances as do those stand-alone, off-the-shelve receptacle parts.

Figure 3:
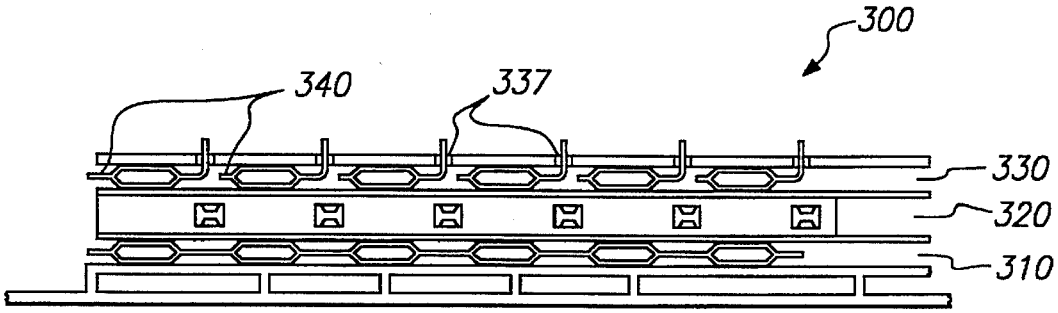
FIG. 3 illustrates a simplified and partial elevational view of an embodiment of an encasement from the rear of the power center of FIG. 1, the view shown having the power center housing removed showing the three pods suitably aligned for receiving device plug prongs.
Figure 4:
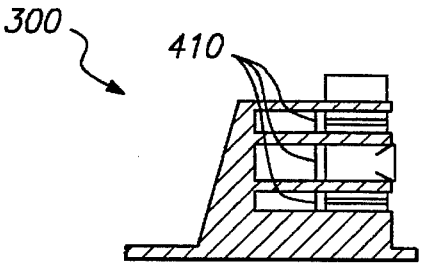
FIG. 4 illustrates a simplified and partial side elevational view of the encasement shown in FIG. 3.

Referring now to FIGS. 3 and 4, an encasement 300 preferably of the same material as the power center housing 110 is unitarily constructed and is integral to the bottom portion of the power center housing 110. This encasement 300 is inside the power center housing 110 and adjacently aligned with receptacle apertures together forming the plurality of receptacles 160. The FIGS. 3 and 4 are simplified in that some details are left out for better showing the present invention. The encasement 300 has three pods 310, 320, 330 each suitably aligned lengthwise with the apertures of the series of receptacles 160 on the back side 130 of the power center 110. The pods 310, 320, 330 have widths which are designed to receive the prongs of device computer plugs which extend through the receptacle apertures for power distribution. Two of the pods 310, 320 each encases an electrically conductive contact strip and each strip having a length substantially the same as the length of the plurality of the receptacles 160 and each strip being aligned with one aperture of each of the plurality of receptacles. The strips are preferably configured to make contact with the prongs of the device computer plugs when they are received into the pod and they are preferably of a brass alloy material or any material that is flexible and amenable to electrical coupling such as soldering. Using known methods such as soldering, one of the two strips is electrically coupled to the "neutral" lead (not shown) whereas the other strip is electrically coupled to the "ground" lead (not shown) from the power center plug. Preferably, these two pods 310, 320 are disposed closer to the bottom portion of the power center housing 110.

The remaining pod 330 situated toward the top of the encasement 300 encases a plurality of electrically conductive contact strips 340, each strip being aligned with one aperture of one receptacle of the power center 100 and the strip being electrically isolated from the other strips but each strip is configured in a manner to receive and to make contact with a prong of a computer device plug. Preferably, openings such as slits 337 are suitably placed along the top side of this pod 330 for providing access for electrical coupling to the contact strips 340. One embodiment provides slits 337 along side this pod 330 and configures an end of the strips to be bent and be placed above the encasement through the slits for easy access for electrical coupling. These strips 340 are suitably configured for coupling to the "hot" lead (not shown) of the power center plug.

In FIGS. 3 and 4, the contact strips in the two pods 310 and 330 are implemented in a manner to receive and to make contact with the two flat blades of a 3-prong device plug inserted through the associated receptacle apertures. The contact strip seated in the pod 320 is designed to receive and to make contact with the ground pin of the 3-prong device plug. All contact strips may be removably or fixedly seated to their respective pods using known methods. Further, ridges 410 shown for structural support in FIG. 4 are not shown in FIG. 3 for simplification reasons.

The ON-OFF switches 140 implementing known art in wiring are suitably electrically coupled between each receptacle and the Hot, Neutral and Ground leads (not shown) of the power center plug for associating each ON-OFF switch 171 to at least one receptacle 170, thus, controlling the availability of electrical power to the receptacle(s) via the use of its associated ON-OFF switch. In other words, when the switch 171 is ON, a device plug plugged into its associated receptacle 170 would be suitably connected for drawing electrical power from the wall outlet via the power center plug and the ON-OFF switch 171; and when the switch 171 is OFF, a device plug plugged into the associated receptacle 170 would not be able to draw any electrical power from the wall outlet. Other features such as surge protection using known technologies (e.g., fuses, not shown) for the receptacle power lines could also be added to the power center 100.

Among other things, one advantage of the present invention is the significant space and cost savings it provides when stand-along, off-the-shelve receptacle components requiring substantial space clearances are replaced with the above-described molded-in receptacle features.

The foregoing descriptions of a specific embodiment of the present invention has been presented for purposes of illustration and description. It is not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

I claim:

1. A power center supplying electrical power from a common power source to a plurality of electronic devices, the power center comprising:

a housing having a front side and a back side;

a plurality of ON-OFF switches disposed on a portion of the front side of the housing, these ON-OFF switches being electrically coupled to the common power source;

a plurality of receptacles disposed on a portion of the back side of the housing for supplying electrical power to connected electrical devices, each receptacle being electrically coupled to the common power source via one of the plurality of ON-OFF switches in a manner so that when the ON-OFF switch is ON, one of the plurality of electronic devices connected to its associated receptacle could then draw electrical power from the common power source and when the ON-OFF switch is OFF, the one electronic device connected to the associated receptacle could not then draw any electrical power from the common power source;

the plurality of receptacles comprising a plurality of prong apertures integral to the back side of the housing and an encasement unitarily constructed with and integral to the housing located inside the power center, the encasement being generally aligned with the plurality of prong apertures and the encasement having a first, a second and a third lengthwise grooves, the first and the second grooves being configured to receive a contact strip each and to be closer to the bottom portion of the power center housing than the third groove and the third groove being configured to receive a plurality of contact strips wherein each strip being electrically isolated from the others and each strip being implemented to receive one prong of a plug of an electronic device, the third groove includes a wall that having openings including slits for end portions of the contact strips to extend through for electrical coupling access; and the common power source providing electrical power via "neutral", "ground" and "hot" leads, and the contact strip in the first groove being electrically coupled to the "neutral" lead, the contact strip in the second groove being electrically coupled to the "ground" lead and each of the contact strip in the third groove being electrically coupled to the "hot" lead via an ON-OFF switch.

2. A power center in accordance with claim 1 wherein the third groove includes a wall that has openings for end portions of the contact strips to extend through for electrical coupling access and the third groove is disposed closer to the top portion of the power center housing than the first and the second grooves and the openings are slits of sufficient widths for the contact strips to extend therethrough.

* * * * *